US007681343B2

(12) United States Patent
Dugelay et al.

(10) Patent No.: US 7,681,343 B2
(45) Date of Patent: Mar. 23, 2010

(54) IRONING APPLIANCE COMPRISING AN IRON AND A PORTABLE BASE

(75) Inventors: Bernard Dugelay, Chaponnay (FR); Pascal Maitre, Felines (FR); Amar Djeroro, Givors (FR)

(73) Assignee: SEB, S.A., Ecully (FR)

( * ) Notice: Subject to any disclaimer, the term of this patent is extended or adjusted under 35 U.S.C. 154(b) by 507 days.

(21) Appl. No.: 11/659,703

(22) PCT Filed: Aug. 26, 2005

(86) PCT No.: PCT/FR2005/002147

§ 371 (c)(1),
(2), (4) Date: Feb. 8, 2007

(87) PCT Pub. No.: WO2006/027464

PCT Pub. Date: Mar. 16, 2006

(65) Prior Publication Data

US 2009/0113770 A1 May 7, 2009

(30) Foreign Application Priority Data

Sep. 2, 2004 (FR) ..... 04 09302

(51) Int. Cl.
*D06F 75/40* (2006.01)
*D06F 79/00* (2006.01)

(52) U.S. Cl. ..... 38/96

(58) Field of Classification Search ..... 38/79, 38/81, 96; 219/246, 259; D32/73; 248/117.1–117.7
See application file for complete search history.

(56) References Cited

U.S. PATENT DOCUMENTS

| | | | | |
|---|---|---|---|---|
| 2,866,614 | A * | 12/1958 | Lael | 248/117.7 |
| 2,904,296 | A * | 9/1959 | Graham | 248/117.7 |
| 3,176,947 | A * | 4/1965 | Inverso | 248/117.6 |
| 3,967,802 | A * | 7/1976 | Lomagno | 248/117.4 |
| 5,108,056 | A * | 4/1992 | McBounds | 248/117.4 |
| 7,086,186 | B2 * | 8/2006 | Kobayashi et al. | 38/96 |

FOREIGN PATENT DOCUMENTS

| | | |
|---|---|---|
| EP | 0 124 039 A | 11/1984 |
| EP | 0 713 938 A | 5/1996 |
| WO | WO 03/066953 A | 8/2003 |

* cited by examiner

*Primary Examiner*—Ismael Izaguirre
(74) *Attorney, Agent, or Firm*—Browdy & Neimark, PLLC

(57) ABSTRACT

The invention relates to an ironing appliance comprising an iron (1) and a portable base (2) provided with a surface (21) for setting down the iron (1), said iron comprising a soleplate (10) on which a body with an integrated handle (11) is mounted. The invention is characterised in the base (2) comprises means for immobilising the iron (1), said means engaging with the body of the iron (1) upstream and downstream of the handle (11) in such a way that the entire ironing appliance can be transported by the handle (11) of the iron.

20 Claims, 4 Drawing Sheets

IRONING APPLIANCE COMPRISING AN IRON AND A PORTABLE BASE

The present invention relates to an ironing appliance composed of an iron and a portable base comprising a surface for setting down the iron when the latter is not being used, and relates more particularly to means for immobilizing the iron on the base.

There is known, from the document WO 03/066953, a steam generator having a portable base provided with a place adapted to set down an iron supplied with steam under pressure via the base. In this document, the generator has straps connected to the base for the transport of the generator, these straps also making it possible to maintain the iron on its rest surface during transport of the generator.

However, such straps for transporting the generator and immobilization of the iron present the disadvantage of being particularly cumbersome and awkward, in particular when the user needs to rest the steam generator on a table for ironing.

Thus, a goal of the present invention is to eliminate these disadvantages by providing an ironing appliance having a portable base provided with a surface for resting an iron and having means to immobilize the iron on the base which are compact and effective. Another goal of the present invention is to provide means for immobilization of the iron which allow the transport of the appliance by the handle of the iron.

For this purpose, the invention has as an aim an ironing appliance composed of an iron and a portable base comprising a surface to set down the iron, the iron having a soleplate surmounted by a body integrating a handle, characterized in that the base has means for immobilizing the iron coming to bear on the body of the iron in front of and behind the handle so that the whole of the ironing appliance can be transported by the handle of the iron.

Such a characteristic at the same time makes it possible to unblock access to the handle of the iron for transport of the generator and to benefit from the solidity of the body of the iron integrating the handle to support the whole of the weight of the ironing appliance during transport.

According to another characteristic of the ironing appliance according to the invention, the means for immobilizing include at least one mobile blocking element that can occupy a folded down position in which the iron can be extracted from its base and a position for immobilization of the iron in which the blocking element comes in proximity to the body of the iron.

According to still another characteristic of the invention, the means for immobilizing the iron on the rest surface comprise a stop on which the rear part of the iron comes to bear and a mobile blocking element that can occupy a position for immobilizing the iron in which the blocking element comes to surround the upper front part of the body of the iron.

Such a characteristic has the advantage of providing a simple and inexpensive means for immobilizing the iron.

According to another characteristic of the invention, the stop immobilizes the rear part of the iron laterally, the blocking element retaining the iron against the stop and laterally immobilizing the front part of the iron when it is in the position for immobilizing the iron.

According to another characteristic of the invention, the base has a device for locking the blocking element in the position for immobilizing the iron.

According to still another characteristic of the invention, the base includes a button for unlocking the locking device.

According to another characteristic of the invention, the blocking element is an arch that is mobile in rotation.

According to another characteristic of the invention, the arch is mobile between an unlocked position in which the arch is disposed substantially in the plane of the rest surface of the iron and a locked position in which the arch is disposed on the upper front part of the iron.

According to another characteristic of the invention, the blocking arch is constituted by a metal rod covered with a flexible plastic material.

Such a characteristic has the advantage of allowing the locking of the arch on the iron after flattening the flexible material so as to immobilize the iron perfectly on the surface of the base.

According to another characteristic of the invention, the blocking arch integrates a gripping strip.

Such a characteristic has the advantage of facilitating the handling of the blocking arch, without risk of burns.

According to still another characteristic of the invention, the arch integrates the lateral abutments being positioned on both sides of the front tip of the iron when the arch is in the unlocked position.

Such a characteristic makes it possible to laterally guide the front tip of the iron when the latter is placed on the rest surface of the base and thus avoids the risks of accidental falls.

According to still another characteristic of the invention, the rest surface for the iron is inclined relative to the lower plane of the base.

Such a characteristic makes it possible to ensure better ergonomics in use at the time of placement of the iron on, or withdrawal from, the base.

According to still another characteristic of the invention, the iron has on its rear part two connection arms connecting the handle to the body of the iron and the stop has a form adapted to partially engage between the connection arms.

One will better understand the goals, aspects and advantages of this invention, from the description given hereafter of a particular embodiment of the invention presented as a non-limiting example, while referring to the annexed drawings in which.

Figure 7A:
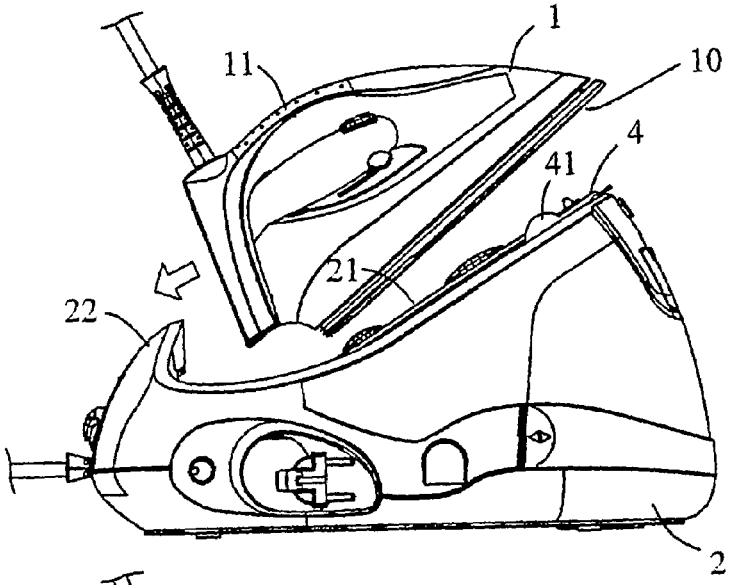
Figure 7B:
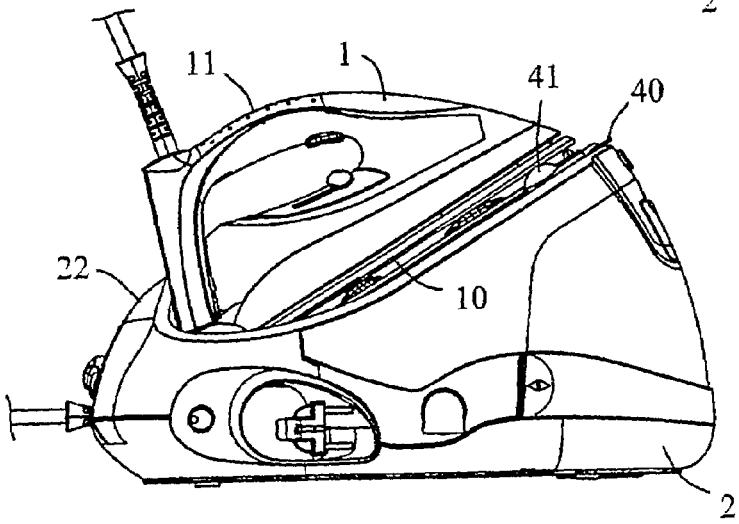
Figure 7C:
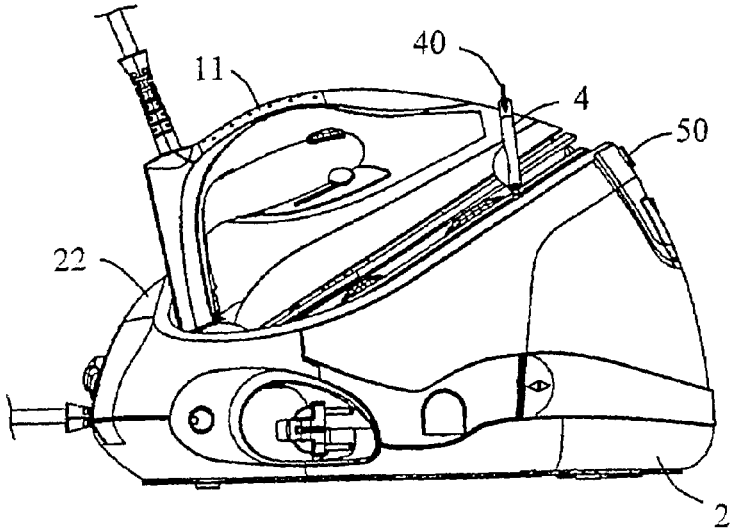

the FIGS. 7*a* to 7*c* represent the various phases of placement and locking of the iron on its base.

Only the elements necessary for an understanding of the invention have been represented. To facilitate reading of the drawings the same elements carry the same references from one figure to another.

Figure 1:
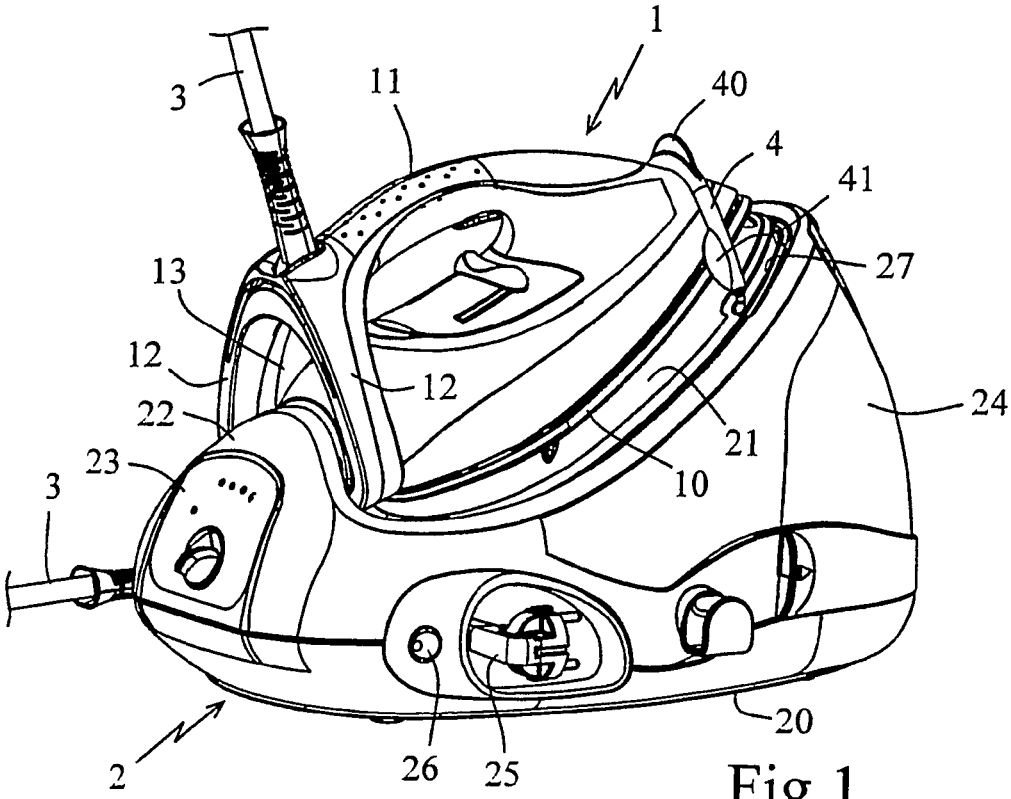
FIG. 1 is a perspective view of a steam generator according to a particular embodiment of the invention when the blocking arch is in position for immobilization of the iron.
Figure 2:
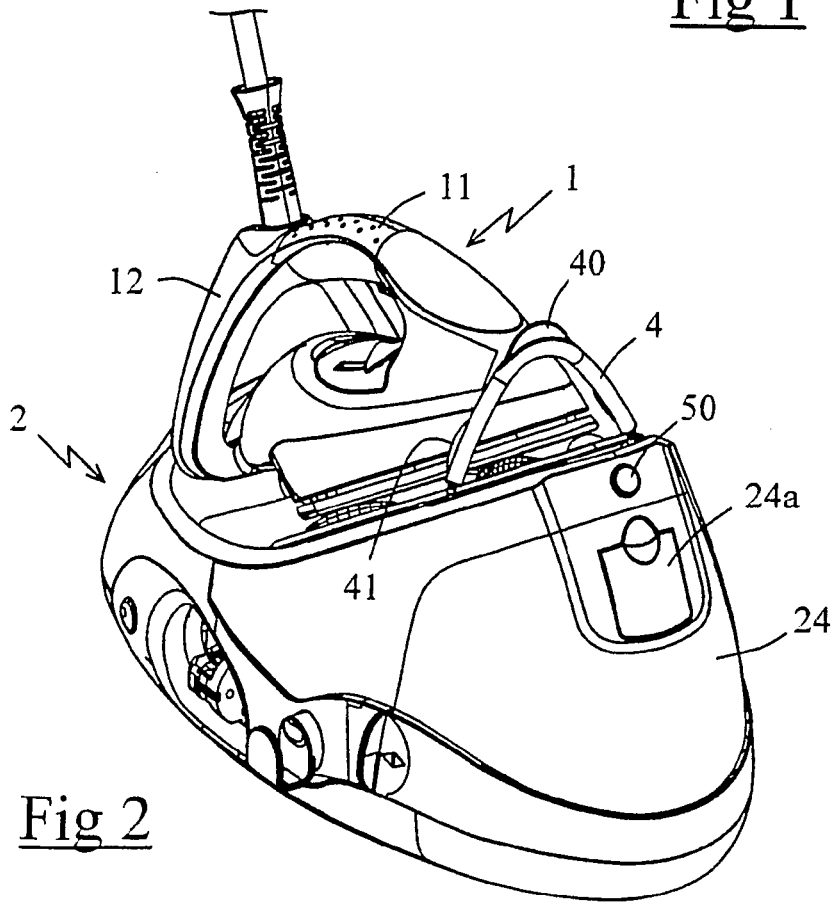
FIG. 2 is another perspective view of the generator of FIG. 1.
Figure 3:
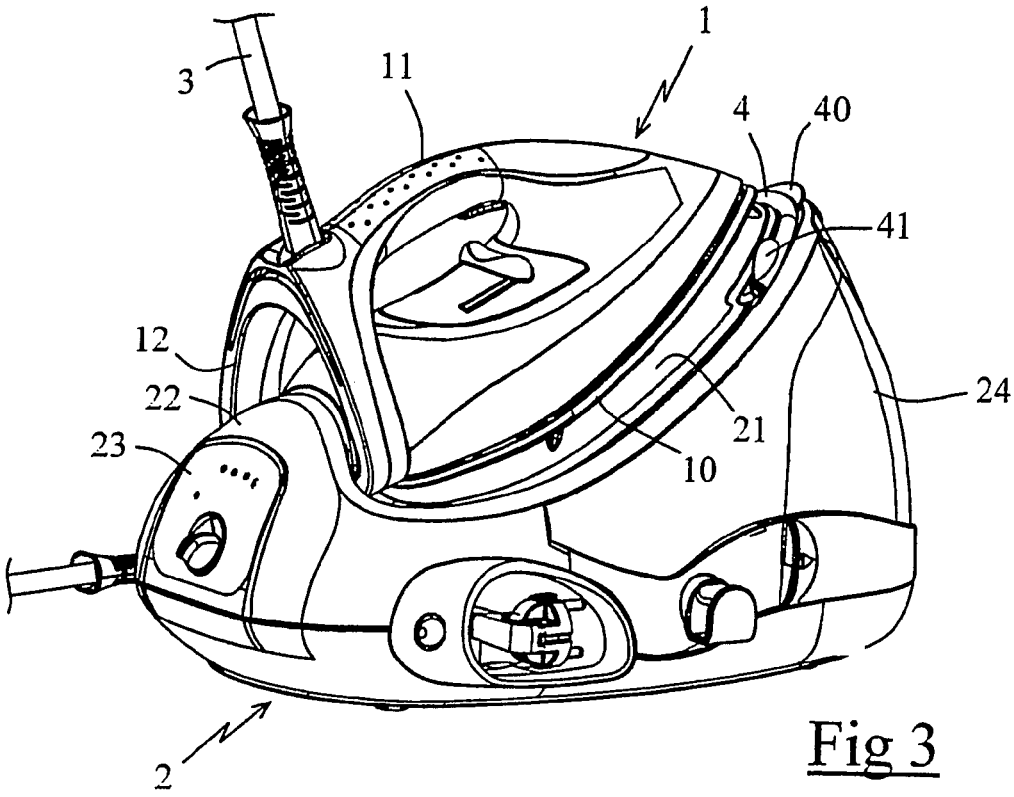
FIG. 3 is a view similar to FIG. 1 with the blocking arch in a folded down position.

FIGS. 1 to 3 represent an ironing appliance of the steam generator type, having conventionally an iron 1 resting on a portable base 2 integrating a tank for the production of steam under pressure, not represented on the figures.

Iron 1 has a heating soleplate 10 surmounted by a one-piece plastic body integrating a handle 11, the latter being prolonged towards the rear of the iron by two arms 12, symmetrically disposed with respect to the longitudinal axis of the iron, constituting the heel of the iron. Handle 11 is prolonged conventionally toward the front of the iron by a nose covering the front tip of soleplate 10. Iron 1 is connected to the base by a flexible cord 3 integrating wires for power supply to the heating soleplate 10 as well as a conduit for supplying steam to soleplate 10 of the iron.

Base 2 has a planar lower surface 20 and presents above this surface, when viewed from the side, a substantially circular contour presenting a truncated part defining an inclined plane 21 constituting a place for resting iron 1, such a configuration having the advantage of great ergonomics of use. Advantageously, the slope of inclined plane 21 is about 30° with respect to the horizontal and inclined plane 21 presents projecting pads allowing base 2 to be thermally isolated from the hot soleplate 10 of the iron.

Base 2 includes, at the foot of inclined plane 21, a stop 22 at which the heel of the iron comes to rest when the iron is posed on the inclined plane, stop 22 presenting advantageously a rounded form coming to fit into a cavity 13 disposed between two arms 12 of the heel of iron 1 so as to immobilize the iron laterally.

Base 2 also has, at the back of stop 22, a control panel 23 for the steam generator and encloses in the space located under inclined plane 21, a removable reservoir 24, more clearly visible in FIG. 2. Reservoir 24 is intended to supply water to the tank of the generator and is provided with a trap door 24*a* for filling.

The steam generator is supplied electrically by means of a power supply cord 25 extending out of base 2 at the level of a storage cavity comprising an automatic cord roller. A switch 26 is provided near this cavity for starting or stopping the heating means for the tank of the generator.

More particularly according to the invention, the base includes an arch 4 making it possible to immobilize iron 1 on base 2 during its transport.

This arch 4 is disposed on the base, at the level of the part of the inclined plane 21 receiving the front tip of soleplate 10 of the iron, and is articulated at the edge of inclined plane 21 so that arch 4 can swivel between a folded down position in which arch 4 is disposed parallel to inclined plane 21 and a position for immobilization of the iron, in which arch 4 is supported substantially against the upper face of the nose of iron 1, arch 4 then occupying a position close to the vertical.

Arch 4 presents advantageously a triangular form mating with the contour of the front end of inclined plane 21, the latter presenting at this location a throat 27 for reception of arch 4, so that, in the folded down position, arch 4 is integrated perfectly in inclined plane 21 as is shown in FIG. 3.

Arch 4 preferentially consists of a metal rod covered locally with a flexible plastic heat-resistant coating, this coating including a gripping strip 40 disposed in the longitudinal axis of base 2. The coating of arch 4 also advantageously integrates abutments 41 protruding laterally on both sides of inclined plane 21 when arch 4 is in the folded down position, so that soleplate 10 of the iron is guided laterally by these abutments 41 when the iron rests on inclined plane 21.

Figure 4:
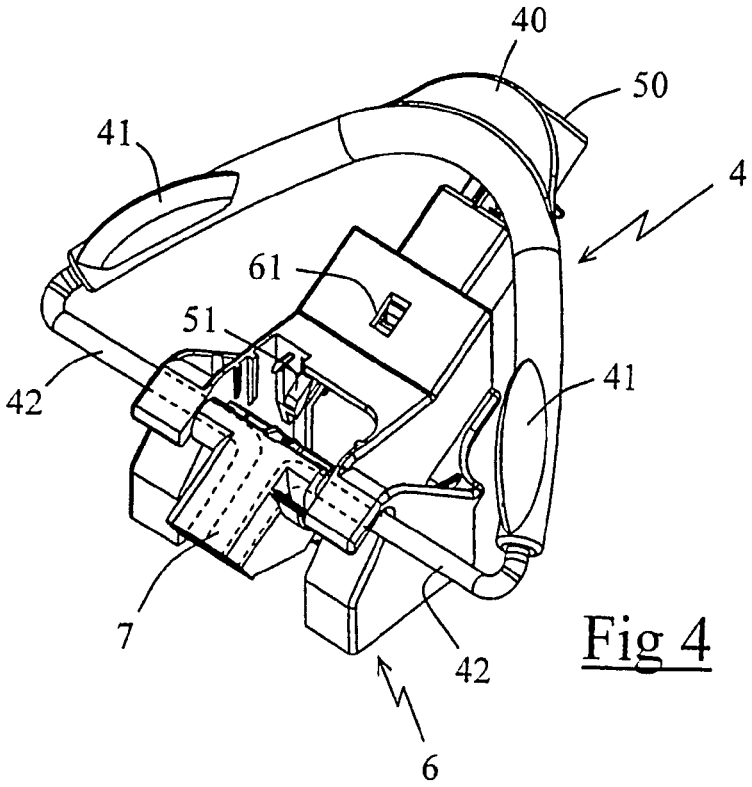
FIG. 4 is an enlarged perspective view of the locking mechanism for the blocking arch, the arch being in the folded down position.
Figure 5:
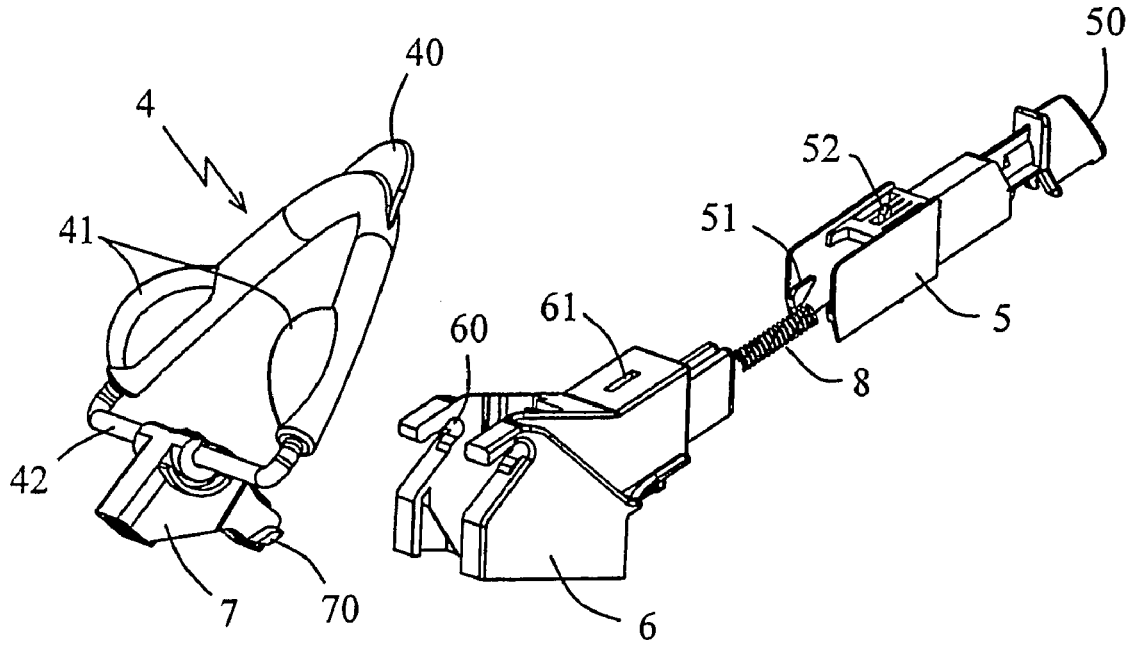
FIG. 5 is an exploded perspective view of the locking mechanism of FIG. 4.

In accordance with FIGS. 4 and 5 which separately represent the locking mechanism of the arch disposed under inclined plane 21, arch 4 is prolonged inside the body of the base by two arms 42 cooperating with a locking mechanism ensuring the locking of arch 4 in the blocking position, an unlocking button 50 being provided on the front part of base 2 to unlock arch 4. The two arms 42 of the arch present coaxial parts which are pivotally mounted through two bearings 60 carried by a frame 6 and bent ends that are inserted into a latch 7 that can be displaced through frame 6 under the effect of the rotation of arch 4.

As one can see more clearly in FIG. 5 which represents an exploded view of the locking mechanism, latch 7 presents lugs 70 intended to come to engage by rotation of the arch behind blocking cams 51 carried by a bolt 5 slidably mounted on the frame. The path in translation of bolt 5 is delimited by a pin 52 mounted on an elastic strip which comes to fit through an opening 61 of frame 6, bolt 5 being urged under the effect of a spring 8 into a locking position and presenting an end forming the unlocking button 50 actuatable by the user.

The operation of the locking mechanism of arch 4 will now be described.

When the user grips strip 40 to cause arch 4 to pivot on the nose of the iron, latch 7 is displaced in rotation towards the interior of frame 6 and lugs 70 carried by latch 7 come in contact with the lower surface of blocking cams 51 the latter presenting a slope adapted to provoke displacement of bolt 5 in opposition to spring 8 towards the interior of frame 6.

Figure 6:
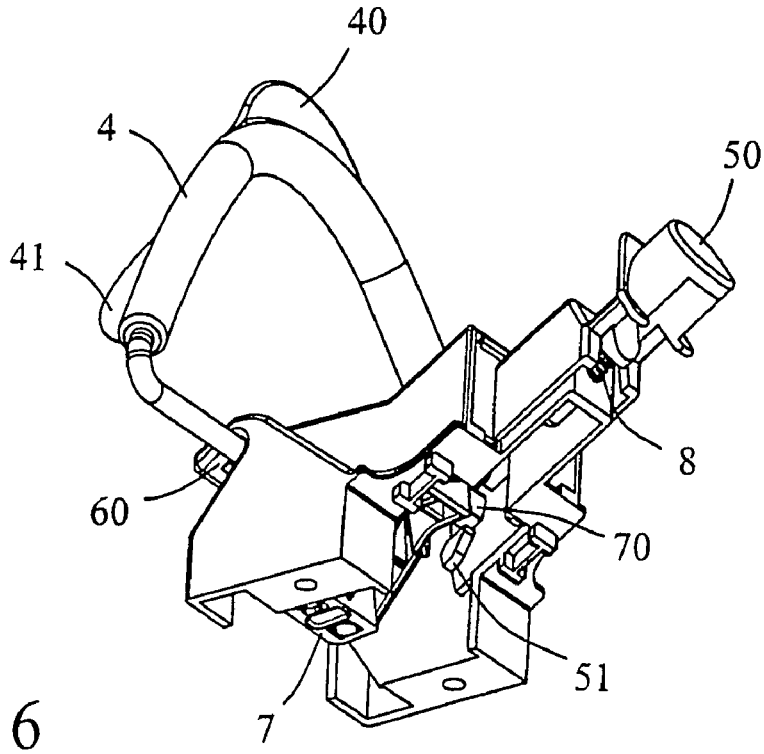
FIG. 6 is a perspective view of the locking mechanism when the blocking arch is locked in position for immobilization of the iron.

This displacement of bolt 5 is carried out until lugs 70 escape above blocking cams 51, bolt 5 being then brought back by spring 8 to its rest position. In this position illustrated in FIG. 6, lugs 70 carried by latch 7 are just above the planar upper surface of blocking cams 51 carried by bolt 5 and the rotation of arch 4 in the opposite direction is impossible. Preferentially, lugs 70 are disposed on latch 7 at a point relatively distant, about a few centimeters, from the axis of rotation of arms 42 so as to provide a substantial blocking torque.

Unlocking of the arch can then only be obtained by pressing on button 50 so as to cause displacement of bolt 5 and to cause escape of the blocking cams 51 from the trajectory of lugs 70.

FIGS. 7*a* to 7*c* illustrate the positioning of iron 1 on its base 2 and the locking of blocking arch 4.

In accordance with the FIG. 7*a*, the user positions iron 1 on base 2 preferably by bringing the heel of iron 1 against stop 22 then by allowing soleplate 10 to rest on the pads of inclined plane 21, abutments 41 carried by arch 4 in the folded down position laterally guiding the front tip of soleplate 10 as is shown in the FIG. 7*b*.

When the user wishes to move the generator, for example to store it, he folds back arch 4 on the nose of the iron, by means of gripping strip 40, until arch 4 is immobilized by the locking mechanism in the blocking position. In this blocking position, stop 22 is partially inserted between arms 12 of the heel of the iron and arch 4 is preferentially applied against the upper face of the body of iron 1 with a slight flattening of the flexible plastic covering arch 4 so that there results therefrom a perfect immobilization, without clearance, of iron 1 on base 2. However, a slight play could also be envisaged between arch 4 in the blocking position and the nose of iron 1 so as to facilitate the locking of arch 4.

Once blocking arch 4 is locked, the user can then transport the generator by gripping handle 11 of the iron, all of the weight being then supported by the one-piece plastic body of iron 1 integrating the handle which has great strength.

Such a device for blocking the iron on the base of the generator thus has the advantage of being at the same time simple in design and allowing the transport of the generator by the handle of the iron without risk of deterioration of the iron, the whole of the weight of the base of the generator being supported by the plastic body of the iron, without straining the connections between the elements of the iron.

Of course, the invention is by no means limited to the embodiment described and illustrated which was given only by way of example. Modifications remain possible, in particular from the point of view of the construction of the various elements or by substitution of technical equivalents, without leaving for that matter the field of protection of the invention.

Thus, in one alternative of realization not represented in the figures, the stop can include an elastic element or a part mobile in translation associated with a compression spring so that a pushing force can be applied to the back of the iron when one immobilizes the front of the iron by means of the blocking arch so that the nose of the iron rests under constraint against the blocking arch in locked position.

In another alternative of realization, the blocking arch could also be mobile in translation rather than in rotation.

In another alternative of realization, the rear stop could be replaced by a second mobile blocking element, such as an arch, coming to immobilize the rear of the iron.

In still another alternative of realization, one can envision immobilizing means engaging automatically when a forceful pushing force is effectuated on the iron resting on the rest surface, the immobilizing means being able to be similar to those used for ski boot bindings.

The invention claimed is:

1. Ironing appliance composed of an iron (1) and a portable base (2) for the production of steam under pressure, said portable base (2) comprising a surface (21) to set down the iron (1), the iron comprising a soleplate (10) surmounted by a body integrating a handle (11), wherein the base (2) has means for immobilizing the iron (1) on said surface (21), said means for immobilizing the iron (1) coming to bear on the body of the iron (1) in front of and behind the handle (11) so that the whole of the ironing appliance can be transported by the handle (11) of the iron, and further wherein said mean for mobilizing include at least one mobile blocking element (4) that can rest in a folded down position in which the iron (1) can be extracted from its base (2) and a position for immobilization of the iron (1) in which the blocking element (4) comes in proximity to the body of the iron (1).

2. Ironing appliance according to claim 1, wherein the means for immobilizing the iron on the rest surface (21) comprise a stop (22) on which the rear part of the iron (1) comes to bear and a mobile blocking element (4) that can occupy a position for immobilizing the iron (1) in which the blocking element (4) comes to surround the upper front part of the body of the iron (1).

3. Ironing appliance according to claim 2, wherein the iron (1) has on its rear part two connection arms (12) connecting the handle (11) to the body of the iron and in that the stop (22) has a form adapted to partially engage between the connection arms (12).

4. Ironing appliance according to claim 2, wherein the stop (22) immobilizes the rear part of the iron (1) laterally, and in that the blocking element (4) retains the iron against the stop (22) and laterally immobilizes the front part of the iron (1) when it is in the position for immobilizing the iron.

5. Ironing appliance according to claim 4, wherein the base (2) comprises a device (5, 6, 7) for locking the blocking element (4) in the position for immobilizing the iron.

6. Ironing appliance according to claim 5, wherein said base (2) includes a button (50) for unlocking said locking device.

7. Ironing appliance according to claim 6, wherein said blocking element (4) is an arch that is mobile in rotation.

8. Ironing appliance according to claim 7, wherein said arch (4) integrates lateral abutments (41) being positioned on both sides the front tip of the iron when the arch (4) is in the unlocked position.

9. Ironing appliance according to claim 7, wherein said arch (4) is mobile between an unlocked position in which the arch (4) is disposed substantially on the plane of the rest surface (21) of the iron (1) and a locked position in which said arch (4) is disposed on the upper front part of the iron (1).

10. Ironing appliance according to claim 9, wherein said blocking arch (4) is constituted by a metal rod covered with a flexible plastic material.

11. Ironing appliance according to claim 10, wherein said blocking arch (4) integrates a gripping strip (40).

12. Ironing appliance according to claim 11, wherein said arch (4) integrates lateral abutments (41) being positioned on both sides the front tip of the iron when the arch (4) is in the unlocked position.

13. Ironing appliance according to claim 12, wherein said rest surface (21) of the iron is inclined relative to the lower plane (20) of the base (2).

14. Ironing appliance according to claim 13, wherein the iron (1) has on its rear part two connection arms (12) connecting the handle (11) to the body of the iron and in that the stop (22) has a form adapted to partially engage between the connection arms (12).

15. Ironing appliance according to claim 1, wherein the base (2) comprises a device (5, 6, 7) for locking the blocking element (4) in the position for immobilizing the iron.

16. Ironing appliance according to claim 15, wherein said base (2) includes a button (50) for unlocking said locking device.

17. Ironing appliance according to claim 1, wherein said blocking element (4) is an arch that is mobile in rotation.

18. Ironing appliance according to claim 17, wherein said arch (4) is mobile between an unlocked position in which the arch (4) is disposed substantially on the plane of the rest surface (21) of the iron (1) and a locked position in which said arch (4) is disposed on the upper front part of the iron (1).

19. Ironing appliance according to claim 1, wherein said rest surface (21) of the iron is inclined relative to the lower plane (20) of the base (2).

20. Ironing appliance according to claim 1, wherein said at least one blocking element is mounted on said base for pivotal movement between the folded down position and the position for immobilization of said iron.

* * * * *